US011097148B2

(12) United States Patent
Kennington

(10) Patent No.: US 11,097,148 B2
(45) Date of Patent: Aug. 24, 2021

(54) FITNESS MACHINE

(71) Applicant: Flexline Fitness, Inc., Agoura Hills, CA (US)

(72) Inventor: Brandon Kennington, Westlake Village, CA (US)

(73) Assignee: FLEXLINE FITNESS, INC., Agoura Hills, CA (US)

( * ) Notice: Subject to any disclaimer, the term of this patent is extended or adjusted under 35 U.S.C. 154(b) by 0 days.

(21) Appl. No.: 16/630,827

(22) PCT Filed: Jul. 13, 2018

(86) PCT No.: PCT/US2018/042034

§ 371 (c)(1),
(2) Date: Jan. 13, 2020

(87) PCT Pub. No.: WO2019/014558

PCT Pub. Date: Jan. 17, 2019

(65) Prior Publication Data

US 2020/0139187 A1 May 7, 2020

Related U.S. Application Data

(60) Provisional application No. 62/532,250, filed on Jul. 13, 2017.

(51) Int. Cl.
*A63B 21/00* (2006.01)
*A63B 24/00* (2006.01)
(Continued)

(52) U.S. Cl.
CPC ..... *A63B 21/169* (2015.10); *A63B 21/0087* (2013.01); *A63B 21/154* (2013.01);
(Continued)

(58) Field of Classification Search
CPC ..... A63B 21/008; A63B 21/0083; A63B 21/0087; A63B 21/0088; A63B 21/40;
(Continued)

(56) References Cited

U.S. PATENT DOCUMENTS 2,474,060 A * 6/1949 Mosher ..... A63B 17/00 482/39
3,387,843 A 6/1968 Chandler
(Continued)

FOREIGN PATENT DOCUMENTS

EP 1201269 A2 * 5/2002 ..... A63B 21/0628
EP 2009292 12/2008
(Continued)

OTHER PUBLICATIONS

"Peloton's hi-tech $2,000 spin bike really could change your life" Website (online). Apr. 26, 2016. Retrieved Aug. 29, 2018. Retrieved from the Internet:<URL: http://www.dailymail.eo.uk/sciencetech/article-3552959/The-hi-tech-2-000-spin-bike-really-chang e-life.html>; Figure 1, pp. 2,3.

*Primary Examiner* — Sundhara M Ganesan
*Assistant Examiner* — Shila Jalalzadeh Abyaneh
(74) *Attorney, Agent, or Firm* — Cislo & Thomas, LLP

(57) ABSTRACT

An exercise device having a stowed configuration and a deployed configuration, in which in the stowed configuration, the exercise device is aesthetically pleasing and suitable for most rooms due to front and side panels that hide the framing of the exercise device, and in the deployed configuration, the side panels are opened to expose the arms, which can be deployed, moved up and down to adjust the height, and used to perform exercises based on a pulley system. Pneumatic cylinders may be operatively connected to the pulley system to provide the resistance for the exercises. Handles having gas actuators may be operatively
(Continued)

connected to the pneumatic cylinders to adjust the resistance.

4 Claims, 13 Drawing Sheets

(51) Int. Cl.
*A63B 21/16* (2006.01)
*A63B 21/008* (2006.01)
*A63B 71/06* (2006.01)

(52) U.S. Cl.
CPC ..... *A63B 21/4035* (2015.10); *A63B 24/0062* (2013.01); *A63B 2024/0093* (2013.01); *A63B 2071/068* (2013.01); *A63B 2071/0658* (2013.01); *A63B 2210/06* (2013.01); *A63B 2210/50* (2013.01); *A63B 2220/56* (2013.01); *A63B 2220/805* (2013.01); *A63B 2220/806* (2013.01); *A63B 2225/093* (2013.01); *A63B 2225/50* (2013.01); *A63B 2230/062* (2013.01); *A63B 2230/755* (2013.01)

(58) Field of Classification Search
CPC ..... A63B 21/4017; A63B 21/4035; A63B 21/4041; A63B 21/043; A63B 21/4045; A63B 21/4047; A63B 21/4049; A63B 22/0048; A63B 22/14; A63B 23/03508; A63B 23/035; A63B 23/03516; A63B 23/129; A63B 23/1254; A63B 23/1272; A63B 23/1281
See application file for complete search history.

(56) References Cited

U.S. PATENT DOCUMENTS 3,874,657 A * 4/1975 Niebojewski ..... A63B 22/0002 482/104
4,300,761 A * 11/1981 Howard ..... A63B 17/00 482/130
4,603,855 A * 8/1986 Sebelle ..... A63B 21/06 482/103
4,836,535 A 6/1989 Pearson
4,898,381 A * 2/1990 Gordon ..... A63B 21/00072 482/103
4,915,379 A 4/1990 Sapp
4,934,692 A 6/1990 Owens
4,976,428 A * 12/1990 Ghazi ..... A63B 23/03575 482/112
5,197,356 A 3/1993 Kobayashi et al.
5,197,933 A 3/1993 Waters
5,447,480 A 9/1995 Fulks
5,803,880 A 9/1998 Allen
5,813,947 A * 9/1998 Densmore ..... A63B 22/205 482/51
5,823,921 A 10/1998 Dawson
5,910,070 A 6/1999 Henry et al.
5,993,356 A 11/1999 Houston et al.
6,165,110 A 12/2000 Gajda
6,238,323 B1 * 5/2001 Simonson ..... A63B 21/156 482/102
6,296,594 B1 10/2001 Simonson
6,312,363 B1 11/2001 Watterson et al.
6,447,430 B1 * 9/2002 Webb ..... A63B 21/154 482/93
6,592,498 B1 * 7/2003 Trainor ..... A63B 21/153 482/46
6,645,125 B1 11/2003 Stearns et al.
6,893,381 B2 5/2005 Slawinski
7,163,488 B2 1/2007 Anders et al.
7,172,538 B2 * 2/2007 Keiser ..... A63B 21/0087 482/140
D586,410 S 2/2009 Citterio
7,575,537 B2 8/2009 Ellis
7,575,538 B1 * 8/2009 Clark ..... A63B 23/1263 482/103
7,601,105 B1 10/2009 Gipson, III et al.
7,608,024 B2 10/2009 Sechrest et al.
7,608,031 B2 10/2009 Kerry
7,651,442 B2 1/2010 Carlson
7,654,942 B1 * 2/2010 Batea ..... A63B 23/12 482/99
D612,437 S 3/2010 Fenster
7,967,728 B2 6/2011 Zavadsky et al.
7,972,249 B1 * 7/2011 Napalan ..... A63B 21/0628 482/57
8,057,368 B1 11/2011 Lyszczarz
8,075,453 B1 12/2011 Wilkinson
8,096,926 B1 * 1/2012 Batea ..... A63B 21/0628 482/99
8,246,524 B2 8/2012 Castillo
8,388,499 B1 3/2013 Rindfleisch
D679,764 S 4/2013 Alessandri et al.
8,500,607 B2 * 8/2013 Vittone ..... A63B 21/151 482/93
8,506,459 B2 8/2013 Cassidy et al.
8,550,964 B2 10/2013 Ish, III et al.
D692,971 S 11/2013 Alessandri et al.
D692,972 S 11/2013 Alessandri et al.
8,585,554 B2 11/2013 Shavit et al.
D708,274 S 7/2014 Eder
8,834,328 B1 * 9/2014 Batea ..... A63B 21/0628 482/99
9,162,102 B1 10/2015 Eder et al.
9,339,692 B2 5/2016 Hashish
9,539,461 B2 1/2017 Ercanbrack
9,656,116 B2 * 5/2017 Giannelli ..... A63B 21/063
9,675,510 B2 * 6/2017 Moerth-Cross .... A63B 21/0442
9,744,400 B2 * 8/2017 Cole ..... A47B 81/00
9,776,039 B1 * 10/2017 Xu ..... A63B 22/02
D807,445 S 1/2018 Gettle
10,500,442 B2 12/2019 Hong et al.
2002/0013200 A1 1/2002 Sechrest et al.
2002/0039954 A1 4/2002 Simonson
2002/0043909 A1 * 4/2002 Nielsen ..... A47B 85/08 312/237
2002/0091043 A1 * 7/2002 Rexach ..... A63B 21/0626 482/98
2003/0017918 A1 1/2003 Webb et al.
2003/0045406 A1 3/2003 Stone
2003/0226323 A1 * 12/2003 Travez ..... E04F 17/08 52/220.7
2004/0067821 A1 * 4/2004 Kehrbaum ..... A63B 22/02 482/54
2004/0138033 A1 7/2004 Van Straaten et al.
2004/0176226 A1 9/2004 Carlson
2005/0239615 A1 10/2005 Keiser
2006/0100068 A1 5/2006 Volmar
2006/0100069 A1 * 5/2006 Dibble ..... A63B 23/03566 482/98
2006/0189457 A1 * 8/2006 Ripley ..... A63B 21/0628 482/99
2007/0049470 A1 3/2007 Pyles et al.
2007/0072748 A1 3/2007 Lee
2007/0129222 A1 6/2007 Kolomeir
2008/0051269 A1 * 2/2008 Lines ..... A63B 21/4033 482/99
2008/0287267 A1 11/2008 Ellis
2008/0300116 A1 12/2008 Eder
2009/0017997 A1 * 1/2009 Piggins ..... A63B 22/0007 482/94
2009/0093350 A1 4/2009 Jahns
2009/0170675 A1 * 7/2009 Giannelli ..... A63B 21/154 482/139
2009/0181833 A1 * 7/2009 Cassidy ..... A63B 21/156 482/94
2012/0015784 A1 1/2012 Reed
2013/0157616 A1 6/2013 Lyszczarz
2013/0172153 A1 7/2013 Watterson et al.
2014/0066257 A1 3/2014 Shavit et al.

(56) References Cited

U.S. PATENT DOCUMENTS

| | | | | |
|---|---|---|---|---|
| 2014/0113779 | A1 | 4/2014 | Loach | |
| 2014/0287876 | A1 | 9/2014 | Etter et al. | |
| 2015/0182773 | A1* | 7/2015 | Olson | A63B 24/0062 482/8 |
| 2015/0255002 | A1* | 9/2015 | Harris | E04H 1/125 434/247 |
| 2015/0273261 | A1 | 10/2015 | Huang | |
| 2015/0367162 | A1 | 12/2015 | Mueller | |
| 2016/0074698 | A1* | 3/2016 | Figueroa | A47C 17/38 5/2.1 |
| 2016/0121156 | A1 | 5/2016 | Bach | |
| 2017/0246507 | A1 | 8/2017 | Kennington | |
| 2017/0319941 | A1 | 11/2017 | Smith et al. | |
| 2018/0021616 | A1 | 1/2018 | Orady et al. | |
| 2018/0243600 | A1 | 8/2018 | Kennington | |
| 2019/0099632 | A1 | 4/2019 | Orady et al. | |
| 2019/0099633 | A1 | 4/2019 | Orady et al. | |
| 2019/0099637 | A1 | 4/2019 | Valente et al. | |
| 2019/0099652 | A1 | 4/2019 | Orady et al. | |
| 2020/0047027 | A1 | 2/2020 | Ward et al. | |
| 2020/0047031 | A1 | 2/2020 | Orady et al. | |
| 2020/0086197 | A1 | 3/2020 | Kim | |

FOREIGN PATENT DOCUMENTS

| | | | | |
|---|---|---|---|---|
| FR | 2721486 | A1 * | 12/1995 | A63B 23/00 |
| FR | 2836835 | A3 * | 9/2003 | A63B 63/083 |
| FR | 2902020 | A3 * | 12/2007 | A63B 21/4047 |
| JP | S50008628 | A | 1/1975 | |
| JP | 2000237364 | A | 2/2002 | |
| WO | WO-8601735 | A1 * | 3/1986 | A63B 22/203 |
| WO | WO 1986006644 | | 11/1986 | |
| WO | WO 1997000031 | | 1/1997 | |
| WO | WO 2008152627 | | 12/2008 | |
| WO | WO 2011115443 | | 9/2011 | |
| WO | WO 2012140622 | | 10/2012 | |
| WO | WO 2015196158 | | 12/2015 | |
| WO | WO-2015196158 | A1 * | 12/2015 | A63B 21/00069 |
| WO | WO-2016132132 | A1 * | 8/2016 | A63B 21/154 |

* cited by examiner

FITNESS MACHINE

CROSS-REFERENCE TO RELATED APPLICATION

This patent application is a national phase application of PCT Patent Application No. PCT/US2018/042034, filed Jul. 13, 2018, which claims the benefit of U.S. Provisional Patent Application Ser. No. 62/532,250, entitled "Fitness Machine," filed Jul. 13, 2017, which applications are incorporated in their entirety here by this reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates to exercise equipment and their method of use.

BACKGROUND

Being able to get to a gym to use state of the art equipment for a complete body workout is no longer an easy task due to increasingly busy schedules, horrendous traffic conditions, and overcrowded gyms. As such, more and more people are moving to in-home exercise devices. However, due to space limitations, in-home exercise devices tend to be limited in terms of the number, variety, and intensity of exercises that can be accomplished. In particular, the number, variety, and intensity of exercises tend to decrease as exercise devices become smaller. Larger in-home exercise devices, on the other hand, take up too much space, particularly in smaller homes. In addition, most home exercise devices do not provide any type of coaching, content, or performance data.

Therefore, there is still a need for an in-home exercise system that provides versatility in the number, variety, and intensity of exercises that can be performed in a limited amount of space, as well as offering audio and/or visual content for coaching and data.

DISCLOSURE OF INVENTION

The present invention is directed to an exercise device that has a small footprint, but without compromising the number and intensity of exercises that can be performed. The exercise device comprises a frame with arms that can be deployed from the frame. The arms are height-adjustable to meet the needs of any user and to allow for a variety of different types of exercises to be performed.

Panels are attached to the frame to create an aesthetically-pleasing exercise device that can be placed in practically any room without looking like an exercise device. When in the stowed configuration, substantially all components of the exercise device are hidden from view, except for a monitor, which makes the device look more like a television on a large stand, rather than an exercise device. To use the device, the panels are opened, revealing the arms and allowing the exercises to be performed.

Pulley systems are attached to the arms and the frame to provide the resistance to the user performing exercises. In the preferred embodiment, pneumatic cylinders are used to generate the resistance for the pulley system. Air compressors may be mounted on the frame to provide compressed air to the pneumatic cylinders.

A monitor is attached to the frame to provide feedback, instruction, entertainment, guidance, motivation, and the like for the user. The monitor may be operatively connected to a controller or processor that also allows the user to control various settings for the exercise device. Preferably, the monitor is a touch screen.

The monitor may also be connected to the Internet or other data source to allow users to interact with other remotely located users and trainers, access and download live or prerecorded programs, routines, shows, and the like. In alternative embodiments, the monitor may also act as television, computer, or other electronic device that uses a monitor when the device is not being used for exercise.

MODES FOR CARRYING OUT THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
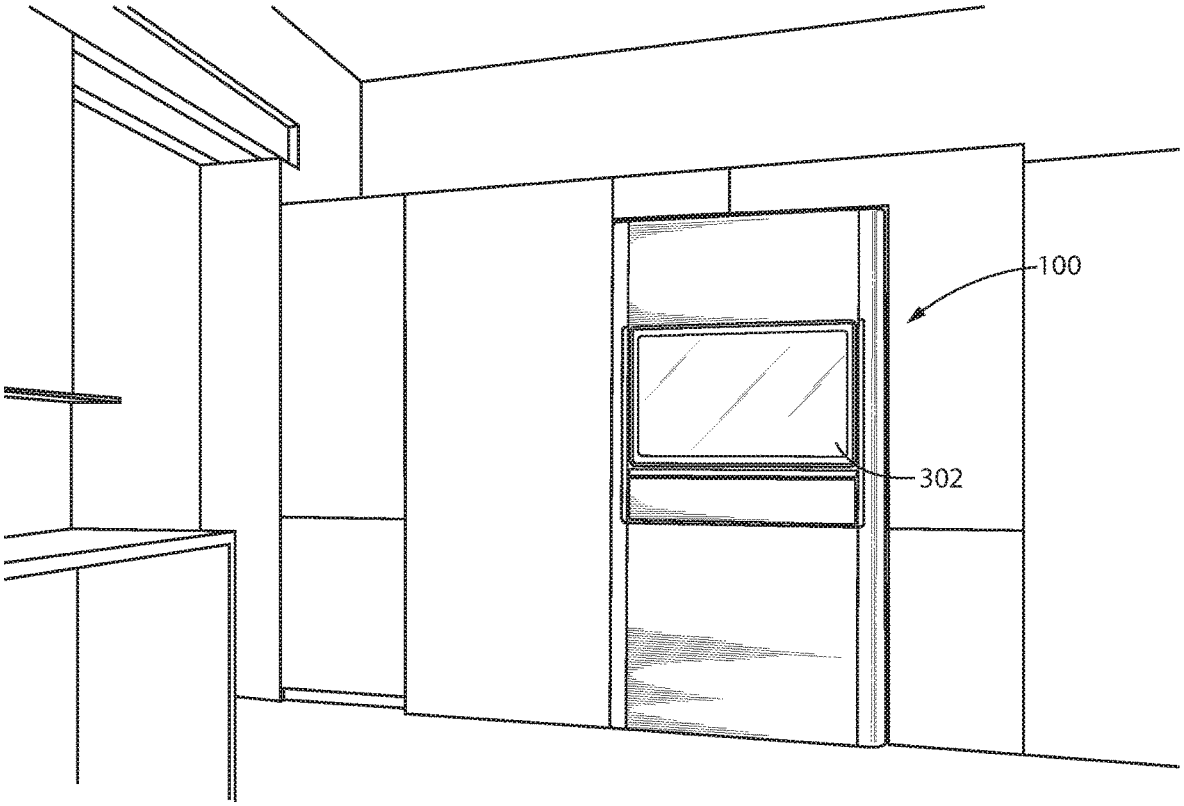
FIG. 1 shows an embodiment of the present invention installed in a home.

The present invention is directed towards an exercise device 100 that minimizes the occupied footprint, while maximizing the versatility of exercises that can be performed. Although designed to be used in homes, in light of the features disclosed herein, the exercise device can also be used in gyms, corporate locations, hotels, offices, and the like. When not in use and in the stowed configuration, the aesthetically pleasing design of the exercise device 100 essentially renders the device hidden in plain view, as shown in FIG. 1. The exercise device 100 blends in naturally with the décor of the home, for example, FIG. 1 shows the exercise device 100 in the stowed configuration in the kitchen area. Installed adjacent to cabinetry, the exercise device 100 looks like a television or a kitchen appliance rather than an exercise device.

Similarly, the exercise device 100 can be attached to a wall adjacent to the kitchen area, placed in the living room, bedroom, office, or almost any other room in the home. In the stowed configuration, the exercise device 100 does not obstruct usage of the kitchen or the adjoining room. Aesthetically, the exercise device 100 does not standout as being out of place. Alternatively, the exercise device 100 could be installed within a wall of custom cabinetry for a completely built-in look.

During use, the exercise device 100 requires a relatively small footprint, while a small workout area for the user is required. Due to the slim design, the exercise device 100 takes up very little square footage from the floor. However, a small area is required to perform the exercises when the exercise device 100 is in the deployed configuration due to one or more projecting arms 202, 204. Even in the deployed configuration, the exercise device 100 is still aesthetically pleasing and does not look like an exercise device. Again, very little square footage is taken up by the exercise device 100 while a small area is required to perform the exercises. Alternatively, the exercise device 100 may be coupled with the floor and/or ceiling to make it free standing.

Figure 2A:
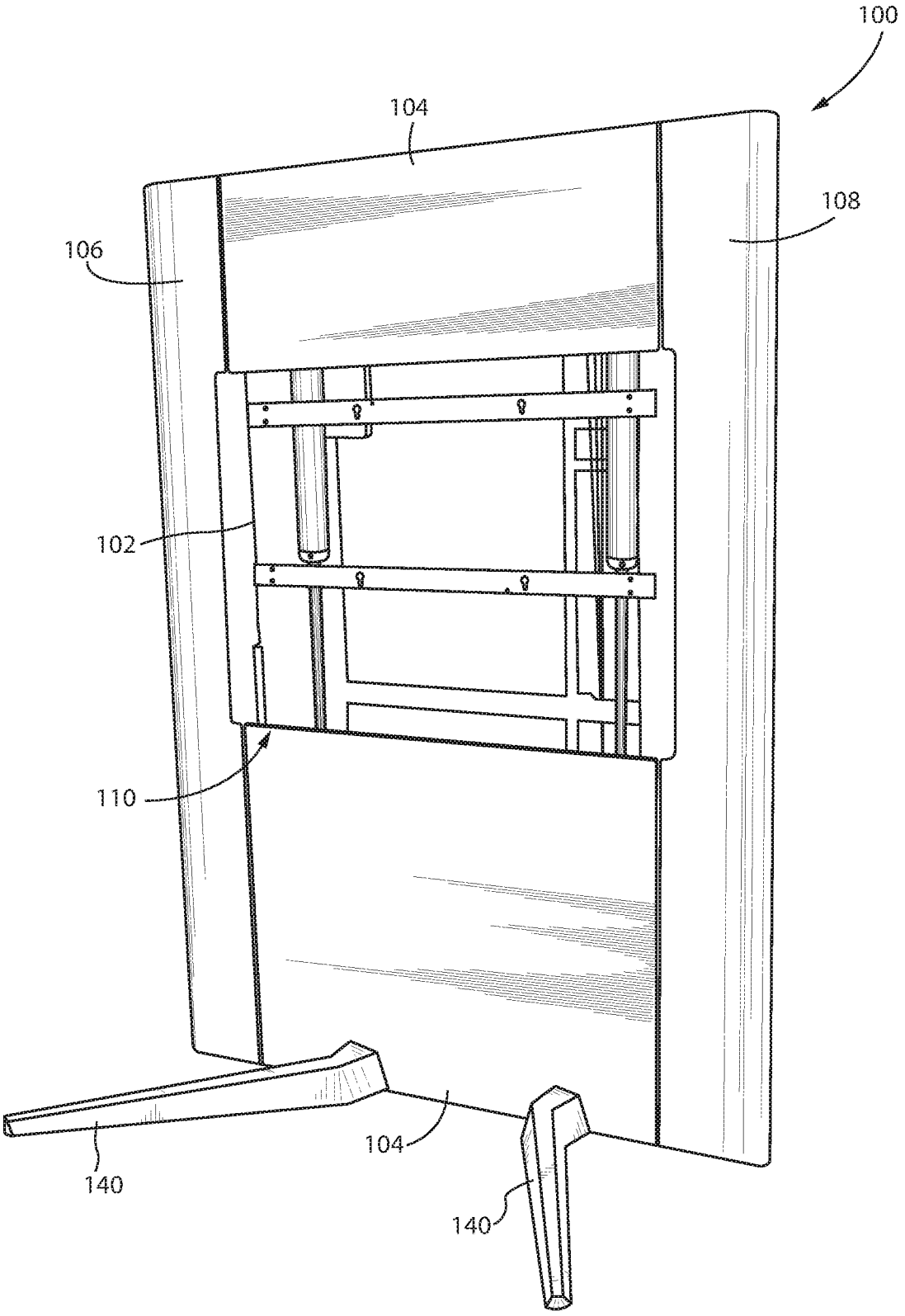
FIGS. 2A-2C show an embodiment of the present invention, without a monitor, being deployed.
Figure 2B:
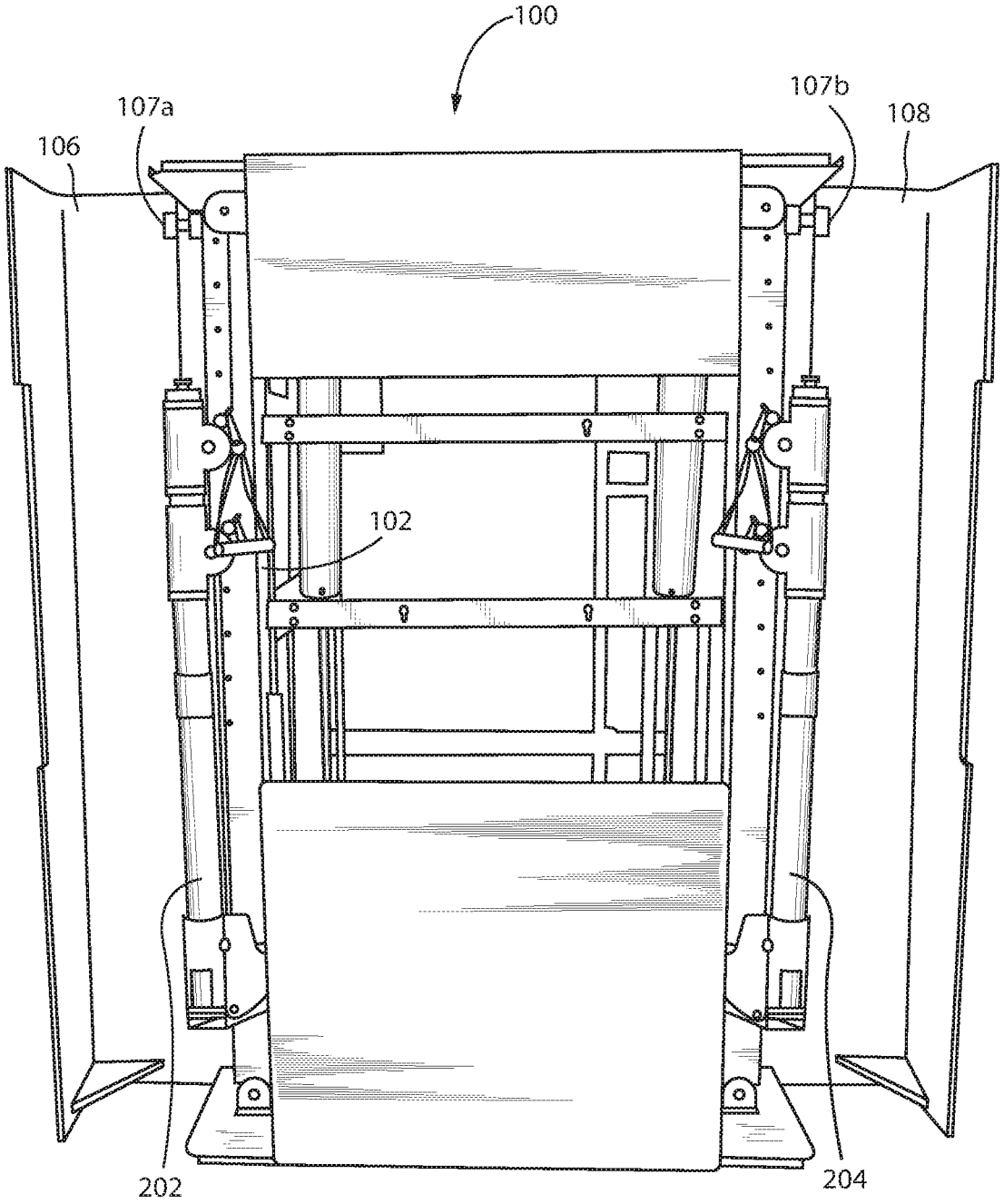
Figure 2C:
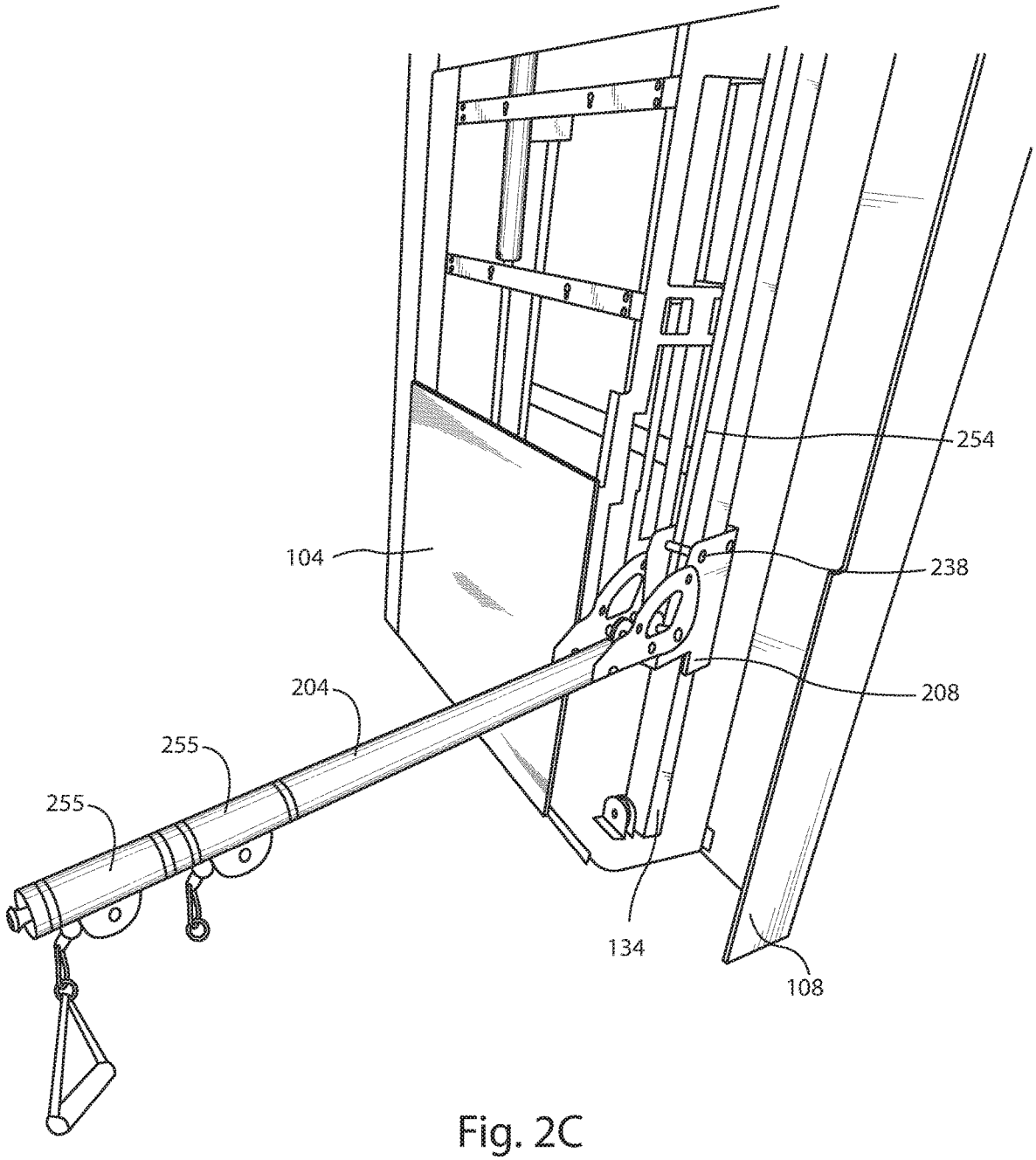

FIGS. 2A-2C show deployment of the exercise device 100 starting from the stowed configuration. FIG. 2A shows an embodiment of the exercise device 100 in the stowed configuration, but with the monitor 302 removed. In some embodiments, as shown in FIG. 2A, the exercise device 100 may have one or more feet 140 so as to be free standing. The exercise device 100 of the present invention comprises a frame 102 to which the other components of invention are directly or indirectly attached for structural support. The exercise device 100 comprises a front panel 104 attached to the frame 102 and two side panels 106, 108 attached to the frame 102 on opposite sides of the front panel 104. In the closed configuration, the two side panels 106, 108 and the front panel 104 define an opening 110 inside which a monitor 302 can be installed and attached to the frame 102. Although the preferred embodiments may show the exercise device 100 having bilateral symmetry with components on one side having corresponding components on the opposite side (e.g. the side panels 106, 108 and arms 202, 204), the inventive concepts described herein can also be employed with only one of the corresponding components.

The two side panels 106, 108 may be attached to the frame 102 by hinges 107*a*, 107*b*. This configuration allows the two side panels 106, 108 to swivel from a closed configuration as shown in FIG. 2A to an open configuration to expose the arms 202, 204 of the exercise device 100 as shown in FIG. 2B. The arms 202, 204 are the components of the exercise device 100 that the user interacts with to perform the exercises. The arms 202, 204 are attached to the frame 102 in manner that allows the arms 202, 204 to be deployed and to be stowed away.

FIG. 2A shows the arms 202, 204 in the stowed configuration with the side panels 106, 108 in the closed configuration, and the pair of arms 202, 204 hidden from sight. FIG. 2B shows the side panels 106, 108 in the open configuration, with the arms 202, 204 still in the stowed configuration. FIG. 2C shows one of the arms 204 being deployed. In some embodiments, the exercise device 100 may have only one arm 202. In some embodiments, the exercise device 100 may have more than two arms.

Figure 3A:
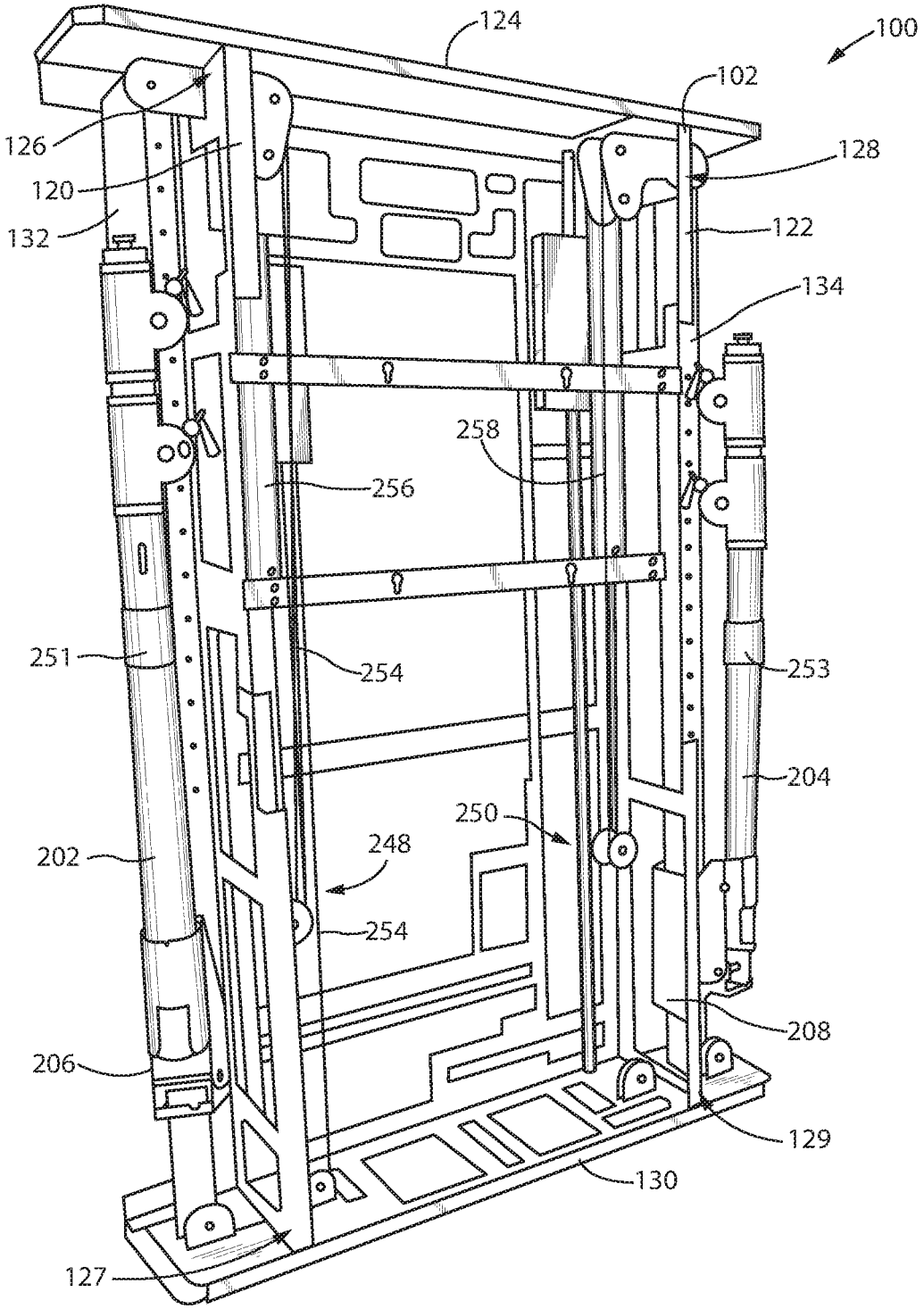
FIGS. 3A-3E show an embodiment of the present invention with the monitor and panels removed to show the internal structures.
Figure 3B:
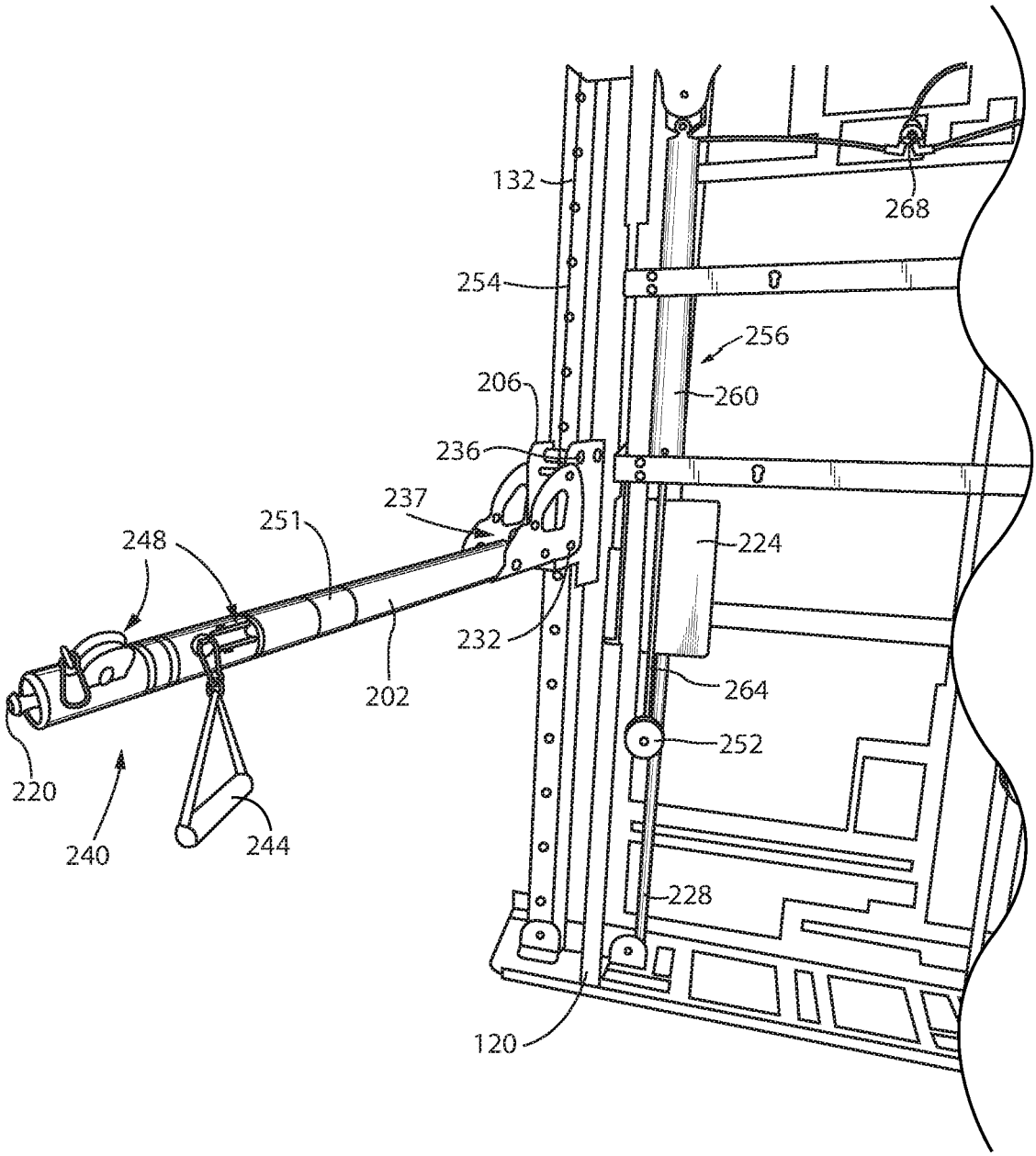

FIG. 3A shows the exercise device 100 with the panels 104, 106, 108 removed to show the internal structures. The exercise device 100 comprises the frame 102 and a resistance system mounted on the frame 102. The frame 102 provides the structural framework for the exercise device 100, and the resistance system provides the components for performing the exercises. The resistance system may be comprised of arms 202, 204, a pulley system 248, 250, and resistance generators 256, 258, each resistance generator operatively connected to one of the pair of arms 202, 204 to provide resistance to the user during performance of his or her exercises. Although the resistance system can be comprised of one arm 202, one pulley system 248, and one resistance generator 256 operatively connected to the arm, in the preferred embodiment, the resistance system comprises a pair of arms 202, 204, a pair of pulley systems 248, 250, and a pair of resistance generators 256, 258 operatively connected to the pair of arms 202, 204 so that exercises can be performed for each side of the body simultaneously. In some embodiments, the exercise device 100 may comprise a pair of arms 202, 204 with a single pulley system 248 and a single resistance generator 256.

The frame 102 may comprise a pair of vertical frames 120, 122 (each vertical frame 120 having a top end 126, 128 and a bottom end 127, 129 opposite the top end 126, 128), a top plate 124 attached to top ends 126, 128 of the vertical frames 120, 122, and a base plate 130 connected to the bottom ends 127, 129 of the vertical frames 120, 122. The frame 102 may further comprise a pair of slide posts or poles 132, 134 placed adjacent to the vertical frames 120, 122. Each vertical frame 120, 122 may have one slide pole 132, 134 adjacent to it, so each slide pole 132, 134 is adjacent to a respective vertical frame 120, 122. As shown in the figures, the slide poles 132, 134 are elongated structures upon which the arms 202, 204 may be mounted.

The frame 102 is constructed from strong, rigid materials, such as metal, so as to be able to withstand the amount of force intended to be imposed on the frame 102, although other suitable materials may be used. The frame is configured to be attached to the floor, the wall, and/or the ceiling. Using the resistance system, the user applies a significant amount of force on the frame 102.

In the preferred embodiment, the resistance system is comprised of a pair of arms 202, 204, a pair of pulley systems 248, 250, and a pair of resistance generators 256, 258. The pair of arms 202, 204 are attached to the frame 102 and set various components of the pulley systems 248, 250 in a variety of position for different types of exercises. The resistance generators 256, 258 are operatively connected to the pulley system 248, 250 to provide a resistive force for the user during an exercise.

FIGS. 3A-3E, show the exercise device 100 in various configurations with the panels 104, 106, 108 removed to expose the internal structures. Each arm 202, 204 is attached to one slide pole 132, 134. The slide poles 132, 134 are positioned on opposite sides of the vertical frames 120, 122. A pair of carriages 206, 208 may be mounted on the slide poles 132, 134, one carriage for each slide pole 132, 134. Preferably, the each arm 202, 204 is attached to its respective slide pole 132, 134 via one of the carriages 206, 208. The carriages 206, 208 may be movably mounted on their respective slide pole 132, 134 to allow the carriages 206, 208 to slide up and down their respective slide pole 132, 134, thereby allowing the arms 202, 204 to move up and down on the slide poles 132, 134 for height adjustment. Therefore, the carriages 206, 208 are configured for translational movement along their respective slide poles 132, 134.

As shown in the figures, the slide poles 132, 134 may be an elongated, sturdy structure, and can be any shape such as cylindrical, rectangular or box-shaped, oval, and the like, so long as it is sufficiently sturdy to withstand the forces applied by the weight of the arm 202, 204 as well as additional forces imparted by the exercises performed, and allow the carriages 206, 208 to move up and down. The slide poles 132, 134 being elongated structures, each defines a respective longitudinal axis.

Figure 3C:
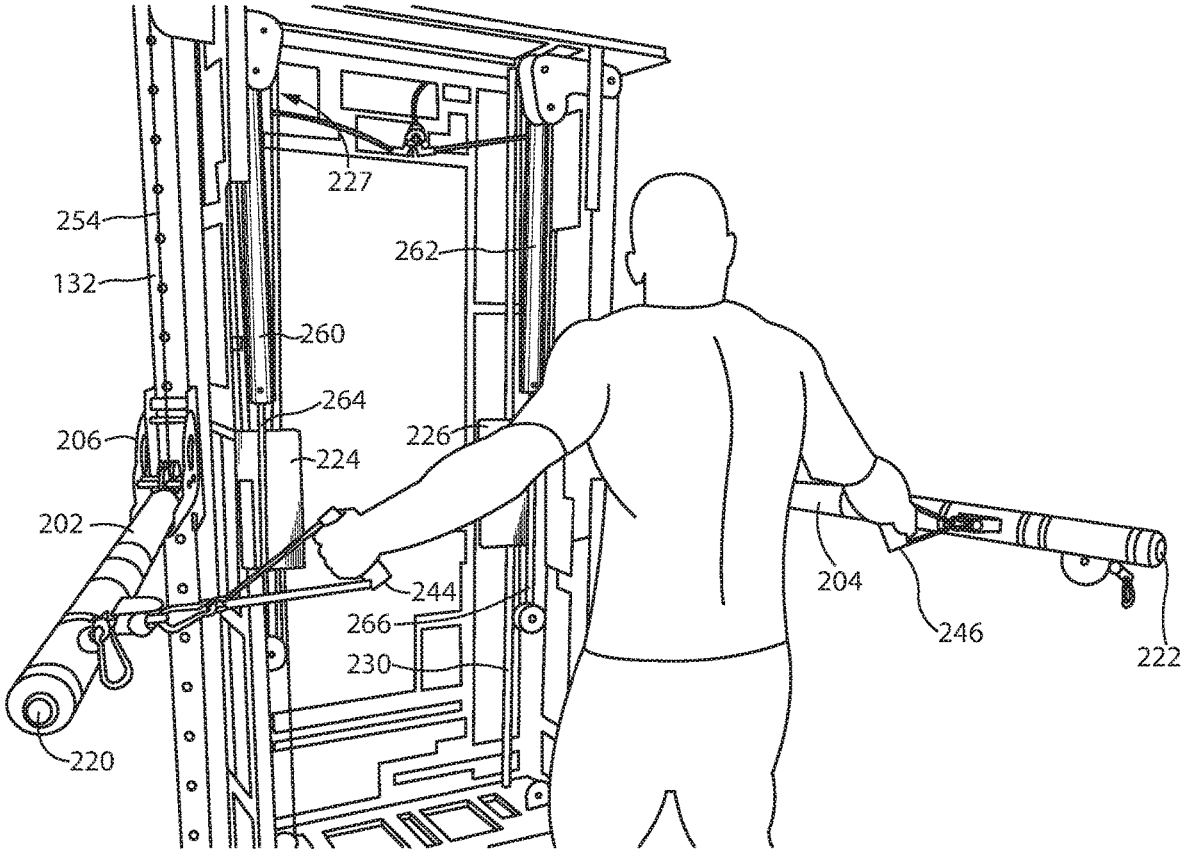

The exercise device 100 may further comprise slide locks 210 (see, FIG. 3E) to stop the sliding action of the carriages 206, 208 and fix the arms 202, 204 at a desired height. The slide locks 210 can be any mechanism that can fix the carriages 206, 208 in place. For example, the slide locks 210 may be a braking system, clamping system, resistance system, obstruction system, and the like. In the preferred embodiment, the slide locks 210 are a type of obstruction system utilizing a peg that is inserted into a hole. For example, the slide poles 132, 134 may have a plurality of holes 214 vertically aligned in series along the length of the slide poles 132, 134. Each carriage 206, 208 or arm 202, 204 may have a slide lock 210 protruding therefrom in a direction towards their respective slide pole 132, 134 as shown in FIG. 3E. Each slide lock 210 may be operatively connected to a carriage release 220, 222. Actuation of the carriage release 220, 222 causes the respective slide lock 210 to retract and move away from their respective slide pole 132, 134 allowing the carriage 206, 208 to slide up and down the slide pole 132, 134. When the carriage release 220, 222 is released, the slide lock 210 moves toward its respective slide pole 132, 134. If the slide lock 210 is aligned with one of the plurality of holes 214, the slide lock 210 can slide into one of those holes 214 thereby obstructing the movement of the carriage 206, 208 and fixing the height of the arms. In some embodiments, the carriage release 220, 222 is located at the free end of the arms 202, 204 for easy access. The carriage release 220, 222 may be connected to its respective slide lock 210 by a connector 212, such as a cable, chain, rope, string, electrical connection, magnets, and the like. In some embodiments, the carriage releases 220, 222 are located on their respective carriage 206, 208. The slide locks 210 may also be wirelessly controlled.

To facilitate movement of the arms, each arm 202, 204 and/or carriage 206, 208 may be operatively connected to a counterweight 224, 226 via a pulley system 227. As the arms 202, 204 are lifted up, the weight of the counterweights 224, 226 are pulled down by the force of gravity, thereby making lifting of the arms 202, 204 easier. When the arms 202, 204 are pushed downwardly, the counterweights 224, 226 rise upwardly and control the downward movement of arms 202, 206 so that the arms do not slam to the floor, which can be dangerous. In the preferred embodiment, each counterweight 224, 226 slides along its own post 228, 230 so as to prevent the counterweights 224, 226 from swinging uncontrollably. In the alternative, a gas strut (sometimes called a gas prop, gas spring, or pneumatic strut), mechanical strut, damper, or other suitable apparatus may be connected with the arms 202, 204 to assist the user in adjusting the arms 202, 204, in lieu of or in addition to the counterweights, or any combination thereof.

The arms 202, 204 may also be pivotally mounted on their respective carriage 206, 208 so that the angles created between the arms 202, 204 and their respective slide pole 132, 134 can be varied. For example, each arm 202, 204 may be connected to its respective carriage 206, 208 via a hinge 232, 234. The hinges 232, 234 allow the arms 202, 204 to swivel or pivot from an upright, stowed configuration in which the arms 202, 204 are generally parallel to the slide poles 132, 134 to a deployed configuration in which the arms 202, 204 project away from their respective slide poles 132, 134 generally in a perpendicular direction or some other oblique angle. Rotation locks 236, 238, can be utilized to lock the arms 202, 204 in the stowed or deployed configuration. Arm releases 251, 253 located on the arms 202, 204 or the carriages 206, 208 may be used to disengage the rotation locks 236, 238.

In some embodiments, the arms 202, 204 may also be configured to move in a lateral or horizontal direction by rotating about the longitudinal axis defined by the slide poles 132, 134. For example, in some embodiments, the carriages 206, 208 may be configured to rotate about their respective slide poles 132, 134. In some embodiments, the slide poles 132, 134 may be configured to rotate about their respective longitudinal axes by being mounted to the frame at their respective top and bottom ends by a swiveling mechanism, such as bearings.

During use, the carriages 206, 208 are locked in place to prevent both translational movement along the slide poles 132, 134, as well as any rotational movement about the longitudinal axis of the slide poles 132, 134.

Each arm 202, 204 is generally a sturdy, elongated pole capable of withstanding the forces described herein. Each arm 202, 204 has a proximate end 237, 239 attached to its respective carriage 206, 208, and a free, distal end 240, 242 opposite their respective proximate end 237, 239. In the preferred embodiment, each arm 202, 204 may be hollow to house the cables associated with the pulley system. In some embodiments, the carriage release 220, 222 is operatively connected to their respective arms 202, 204 at their respective distal ends 240, 242.

Operatively attached to each distal end 240, 242 are at least one handle 244, 246. The term handle as used in this application is interpreted broadly to include many different types of devices that are directly engaged by the user using his hands, feet, arms, legs, shoulders, and any other body part to perform an exercise. For example, handles 244, 246 may be bars, straps, ropes, chains, pads, and the like. The handles 244, 246 are operatively connected to the distal ends 240, 242 of their respective arms 202, 204 via pulley systems 248, 250. The pulley systems 248, 250, utilizing a series of pulleys 252 and cables 254, are routed from the arms 202, 204, through the framing 102, to the resistance generators 256, 258.

More specifically, the cable 254 has a first end and a second end. The cable 254 may be routed through the arm 202 and operatively connected to the resistance generator, wherein the first end of the cable projects out of the arm at a first distal position on the arm, and wherein the second end of the cable projects out from the arm at a second distal position closer to the frame than the first distal position. This setup can be duplicated for the other side of the exercise system. This setup allows for a variety of features. For example, by having handles positioned at various positions along the length of the arms 202, 204, the user can control his or her distance from the frame, and therefore, from the monitor. As such, the handle may be interchangeably connectable to the first end and the second end of the cable with a reversible connector system. The reversible connector may be a ring, an eyelet, a loop, or the like on either the cable or the handle; and a hook, carabiner, D-ring, or the like, on the handle or the cable, respectively, to be able to connect the handle to the cable and disconnect the handle from the cable quickly and easily without the need of any additional tools.

In addition, the user can perform a variety of different exercises using only one arm of the exercise device. For example, two handles 244, 246 may be connected to the same cable at opposite ends. In some embodiments, two users can perform exercises on opposite arms 202, 204 simultaneously on the same exercise system. Four handles may be used, with one handle connected to each end of both cables.

In some embodiments, a cable 254 may be routed through one arm 202, operatively connected to the resistance generator, and routed through the second arm 204. The first end of the cable 254 can project out from the first arm 202 and be attached to a first handle 244, and the second end of the cable 254 can project out from the second arm 204 and be attached to a second handle 246.

In some embodiments, the handles 244, 246 may be operatively connected to the resistance generators 256, 258 to control the amount of resistance created by the resistance generators 256, 258. By way of example, the handle system, as well as the other features, disclosed in U.S. patent application Ser. Nos. 15/320,242; 62/117,897; and 62/014,660, and PCTUS2015/036813, may be incorporated in the present invention. U.S. patent application Ser. Nos. 15/320,242; 62/117,897; and 62/014,660, and PCTUS2015/036813 are incorporated in their entirety here by this reference. The handles 244, 246 comprise a gas actuator to control the resistance generator. For example, one end of the handles 244, 246 may have a gas input actuator to increase the amount of resistive force created by the resistance generator. The second end of the handles 244, 246 may have a gas release actuator to decrease the amount of resistive force created by the resistance generator. The user can grasp the first handle 244 with his or her thumb near the gas input actuator, and grasp the second handle 246 with his or her thumb near the gas release actuator. This allows the user to increase or decrease the resistive force without having to release his or her grips on the handles 244, 246. As shown in FIG. 3C, each arm 202, 204, may have one or more pulley systems 248, 250, each equipped with its own cable 254 and handles 244, 246. The gas input actuators and the gas release actuators can be operatively connected to the resistance generator either through a wired connection or through a wireless connection. A wireless connection can be accomplished through the use of wireless transmission devices, such as Bluetooth®, near field communication, Wifi®, variations thereof, and the like.

The resistance generators 256, 258 provide the actual resistance for the user to perform his or her exercises. Resistance generators 256, 258 may be any device that creates resistance to the cables 254 when the cables 254 are pulled on by the handles 244, 246. In the preferred embodiment, the resistance generators 256, 258 are operatively connected to the frame and provide a resistive force through a linear actuator. Thus, linear movement of the linear actuator is increasingly inhibited to increase the resistive force, and linear movement of the linear actuator is decreasingly inhibited (or increasingly permitted) to decrease the resistive force. By way of example only, the resistance generators 256, 258 may be weights, elastic bands, pneumatic cylinders, and the like. For weights, the movement of the linear actuator supporting the weights is inhibited or permitted by the addition or subtraction of weights, respectively. For elastic bands, the linear movement of the linear actuator is inhibited or permitted based on the length of stretch of the linear actuator. For pneumatic cylinders the linear movement of the linear actuator is inhibited or permitted based on the pressure of the gas inside the pneumatic cylinder. In some embodiments, the resistance generator may comprise an electric motor.

In the preferred embodiment, the resistance generator 256, 258 may be a piston-and-cylinder unit, such as pneumatic cylinders. Each pneumatic cylinder 256, 258 comprises a gas tube or cylinder 260, 262, a piston 264, 266 slidable within its respective gas tube 260, 262, and a gas hose 268 to teed compressed air into the gas tubes 260, 262. A gas compressor 270 is operatively connected to the gas hose 268 to generate the compressed gas and deliver the compressed gas to the gas tubes 260, 262. The piston 264, 266 is driven into its respective gas tube 260, 262 by the user during an exercise by the pulley system 248, 250.

Figure 4A:
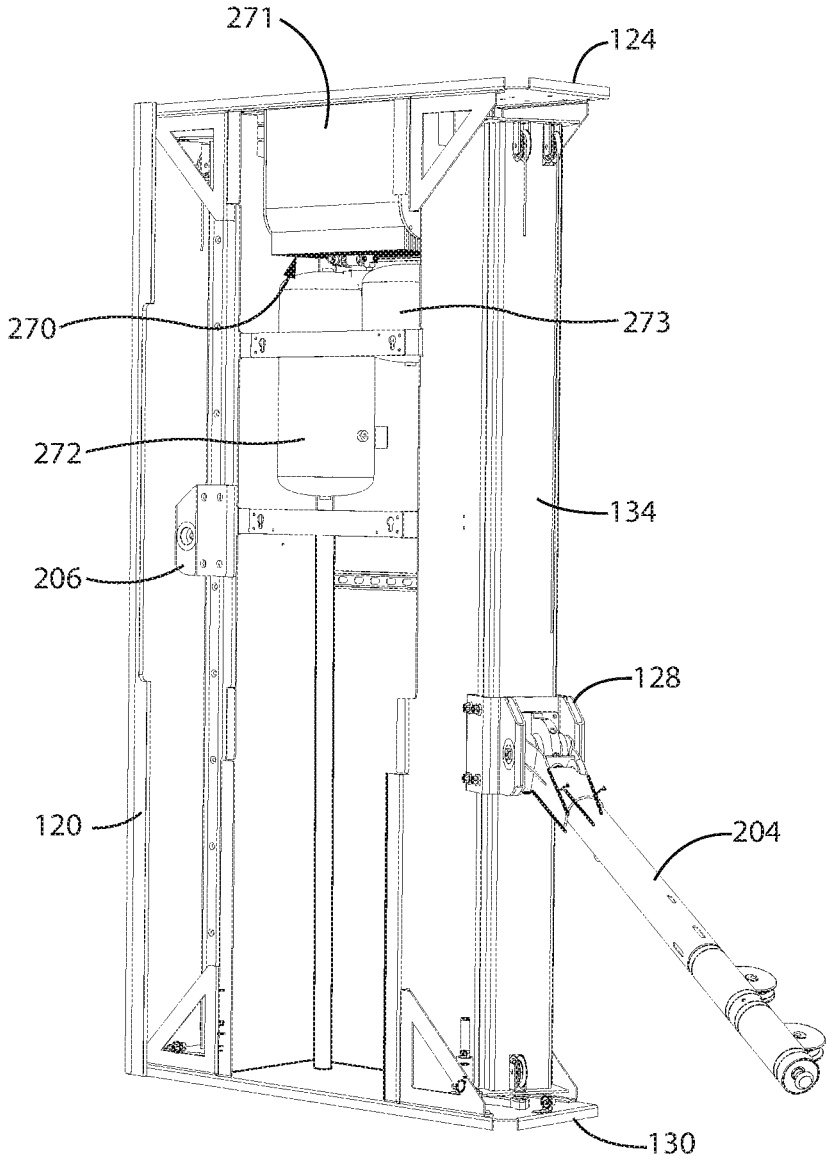
FIGS. 4A and 4B show perspective views of other embodiments of the present invention.
Figure 4B:
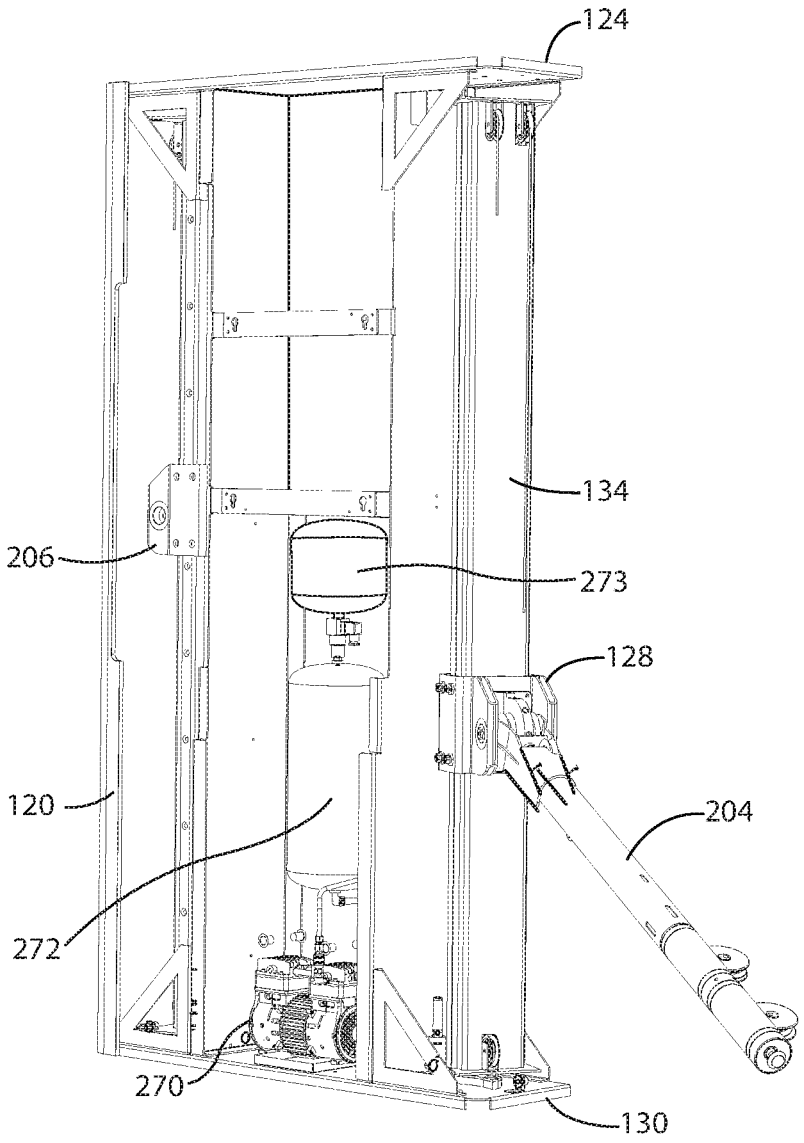
Figure 5:
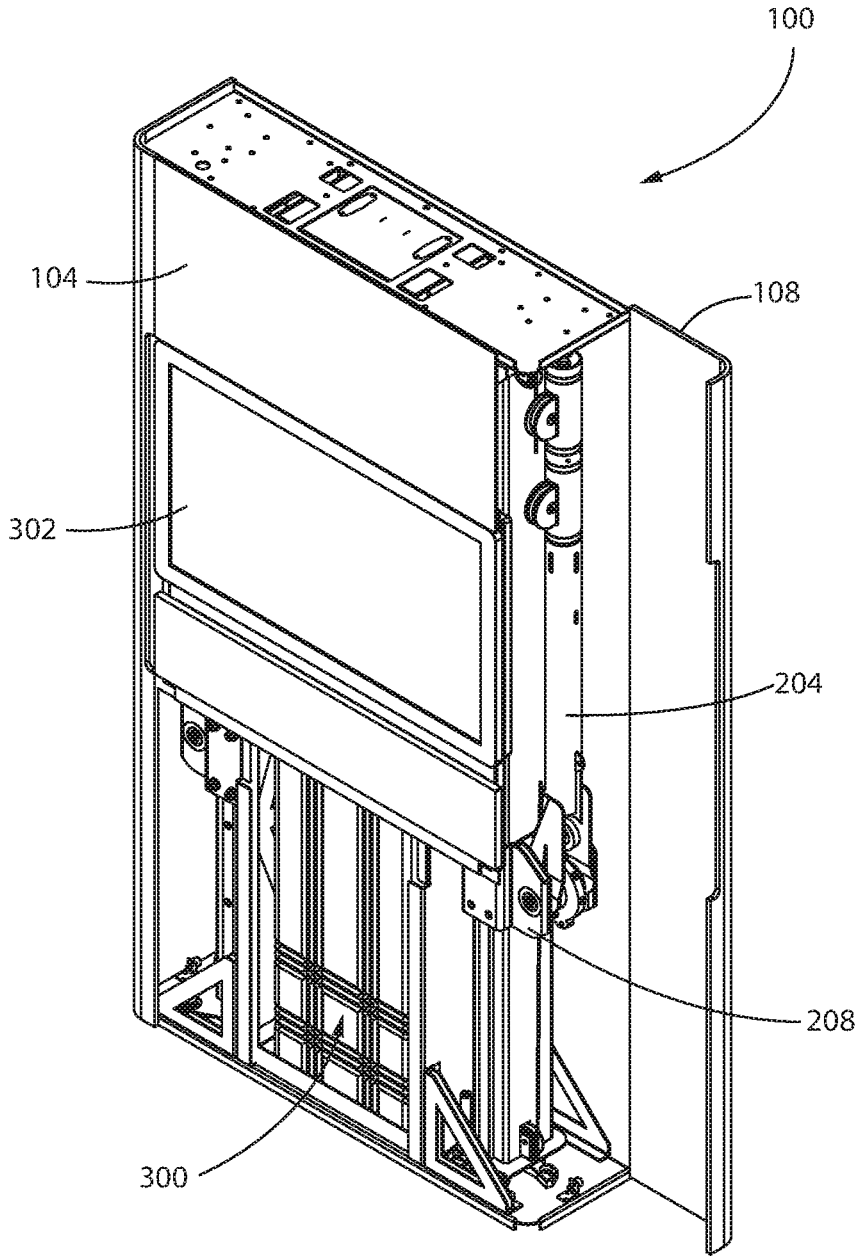
FIG. 5 shows the embodiment of FIG. 4 with the panels removed to show the internal structures.

In some embodiments, as shown in FIGS. 4A and 4B, housed within the frame 102 are a gas compressor 270, an equalizing tank 273, a gas tank, and an accumulator tank 272. The gas compressor 270 may be attached to the frame 102 of the exercise device 100. The gas compressor 270 may be attached the base plate 130. Alternatively, the gas compressor may be attached to the top plate 124. In some embodiments, a compressor housing 271 may be provided to enclose the gas compressor 270 to muffle the sound of the gas compressor 270. As such, the compressor housing 271 may be made from sound absorbing material, and/or comprise a labyrinth design to allow airflow while attenuating compressor noise. In FIG. 5, the compressor housing 271 is shown in an alternate location from the compressor 270, but in a typical configuration the compressor 270 will reside inside the compressor housing 271, at any suitable location. The gas compressor 270 could comprise a recycled gas system to be more efficient and quieter, similar to a refrigerator compressor. The accumulator tank 272 acts as a reserve air pressure tank for the system, allowing the system to quickly pressurize the pneumatic cylinders 256, 258 and not rely on triggering the compressor for every pressure adjustment. Some embodiments may, however, eliminate the accumulator tank 272.

In some embodiments, the exercise device 100 may comprise one or more equalizing tanks 273. The access ports on the gas tubes 260, 262 allow the compressed gas inside the gas tubes 260, 262 to leak out into the equalizing tank 273 so that the piston 264, 266 experiences a near constant resistive force as the piston 264, 266 is being driven into its respective gas tube 260, 262 by the user during an exercise. Therefore, the equalizing tank 273 controls pressure in the cylinder during use.

Because movement of the piston is an indicator of the amount of power exerted by the user during exercise, the resistance generator may comprise a measuring device to measure the amount of power. In the preferred embodiment, the power can be calculated based on the amount of pressure in the cylinder and the speed of movement of the piston at that pressure. Therefore, the measuring device may comprise a pressure sensor to measure the pressure or compressed air in the cylinder (i.e. the gas tubes 260, 262), and a position sensor to measure the translational movement of the piston. The pressure sensor may be provided to monitor the resistive force and adjust the amount of compressed air in the cylinder to maintain the resistive force at the desired level. A clock may also measure the amount of time it takes to move the piston a certain distance to determine the speed of the piston movement.

A valve system may be operatively connected to the access port to control the amount of gas input and released so as to maintain a constant pressure inside the cylinder or gas tubes 260, 262. In a preferred embodiment, the valve system comprises at least one solenoid valve that may be controlled by a microprocessor. In alternative embodiments, the valve system may use a needle valve in lieu of or in conjunction with a solenoid valve, to fine tune the gas flow. The needle valve may be manually operated, or may be connected with the microprocessor and an electromechanical apparatus to operate it, such as a servomotor and gears. In some embodiments, the user and/or the microprocessor can change the rate that the gas is released from or fed into the tank by adjusting how far the intake valve or release valve is opened, which can be useful in changing resistance on the fly in the middle of an exercise.

In some embodiments, the position sensor may be an infrared (IR) sensor. The IR sensor may be in-line with its respective piston 264, 266 on the opposite side of the gas tubes 260, 262 housing the pistons 264, 266 with which the IR sensor is in-line. This IR sensor may be able to calculate movement or position of the pistons 264, 266, which may be by measuring the distance between the IR sensor and its respective piston 264, 266. In some embodiments, the position sensor may be an encoder operatively connected to the piston-and-cylinder unit (i.e. the gas tubes and pistons) to measure piston movement. Other suitable apparatus to measure piston or cable movement may also be used.

By detecting movement of the pistons 264, 266 (or cables 254) as a function of time, the rate or velocity of the piston movement can be determined. The equalizing tank 273 may have a pressure sensor to determine the amount of pressure in the gas tubes 260, 262. Knowing the velocity of the pistons 264, 266 and the pressure in the gas tubes 260, 262, the power being exerted by the user during an exercise can be calculated. This data can be used to optimize and customize a user's exercises, which can be important for high level athletes. Such data can also be used to summarize/analyze completed workouts and plan subsequent workouts.

The pulley system 248, 250 comprises a set of pulleys 252 and cables 254. In some embodiments, pulleys 252 are attached to their respective arms 202, 204 by a collar 255. The collars 255, each comprising a pulley 252, are mounted on their respective arms and configured to rotate about their respective arms 202, 204 to allow the pulleys 252 to move into different orientations relative to their respective arms 202, 204. The handles 244, 246 are attached to the arms 202, 204 via the collars to allow the user to move the handles 244, 246 into various positions relative to their respective arms 202, 204 to allow the user to pull the cables 254 in numerous directions. For example, the user could pull the cables 254 upwardly, downwardly, to the right, to the left, towards the frame 102, away from the frame 102, and any combination thereof.

In some embodiments, the pulley system may comprise a spiral pulley that counteracts the increase in pressure felt by the resistance system during the stroke of the exercises. As the user pulls the handle, one of the spiral pulleys spirals outward, changing the radius of the pulley and effectively cancelling out the increase in pressure inherent with this pneumatic resistance system.

In the preferred embodiment, the pulley system is configured such that when the user imparts a pulling force on the arms 202, 204 by moving the handle 350 (e.g. pulling or pushing the handle), the pistons 264, 266 are driven into their respective gas tubes 260, 262 and the compressed gas inside the gas tubes 260, 262 provide the resistive force. The resistive force remains constant by dissipating the compressed gas into the equalizing tank 273. The large volume of the equalizing tank 273 relative to the gas tubes 260, 262 keeps the pressure in the gas tubes 260, 262 relatively constant when the pistons 264, 266 are compressed. When the pulling force is removed, the pistons 264, 266 may return back to their original positions. In a system where gas tubes 260, 262 are provided for each arm 202, 204, each gas tube 260, 262 may be connected with a common equalizing tank 273, so that the pressures on each gas tubes 260, 262 are equal.

In some embodiments, the exercise device 100 may further comprise a controller. The controller may be used to control variety of different functions when the exercise device 100 is in use. For example, the controller may be used to control the resistive force created by the resistance system by controlling various components of the gas compressor 270, such as the the valve system in response to signals received from the gas input actuator or the gas release actuator to maintain gas pressure at a desired level. The controller can control the resistive force created by the resistive system either through a wired or wireless connection. A wireless connection can be accomplished through the use of wireless transmission devices, such as Bluetooth®, near field communication, Wifi®, variations thereof, and the like.

In some embodiments, a gas tube 260, 262 may be used as the resistive force for both handles 244, 246. In such an embodiment, both handles 244, 246 may be connected to the same gas tube 260, 262. If the user desires to use only one handle 244, the second handle can be locked against the frame. In some embodiments, each handle 244, 246 may be attached to its own gas tubes 260, 262, which may be connected to a common tank or individual tanks. Therefore, each handle 244, 246 may be attached to their own respective pulley system, arm, and gas tubes. This allows each handle to be independent of the other, especially if the gas tubes are connected to separate tanks.

In some embodiments, the handles 244, 246 may be cylindrical in shape having a first end and a second end opposite the first end. The first end may have a gas input actuator and the second end may have a gas release actuator. The handles 244, 246 may be operatively connected to a controller so that actuation of the gas input actuator causes the accumulator tank 272 to add compressed gas into the gas tube 260, 262, and equalizer tank 273, and actuation of the gas release actuator causes the valve system to open so as to release the compressed gas from the gas tube 260, 262, and tank to adjust the desired resistive force against the piston(s) 264, 266. The handles may be operatively connected to the controller either through a wired connection or through a wireless connection. A wireless connection can be accomplished through the use of wireless transmission devices, such as Bluetooth®, near field communication, Wifi®, variations thereof, and the like.

The gas input actuator may operate a valve system that opens a valve to allow the compressor to add air pressure to the gas tube 260, 262 and tank. Since the handles 244, 246 may be substantially cylindrical in shape, a natural grip on the handles 244, 246 would place the thumbs of the user at one of the ends of the handle 244, 246. Therefore, in one configuration, the user can grasp one handle 244, 246 so that the thumb is adjacent to the gas input actuator. The second handle can be grasped in a second configuration in which the user's other thumb is adjacent to the gas release actuator. This grasping configuration allows the user to control the amount of resistive force without having to release the handles 244, 246 or adjust the position of the user's hands on the handle 244, 246 because the user can press and release either the gas input actuator in one hand or the gas release actuator in the other hand.

Figure 3D:
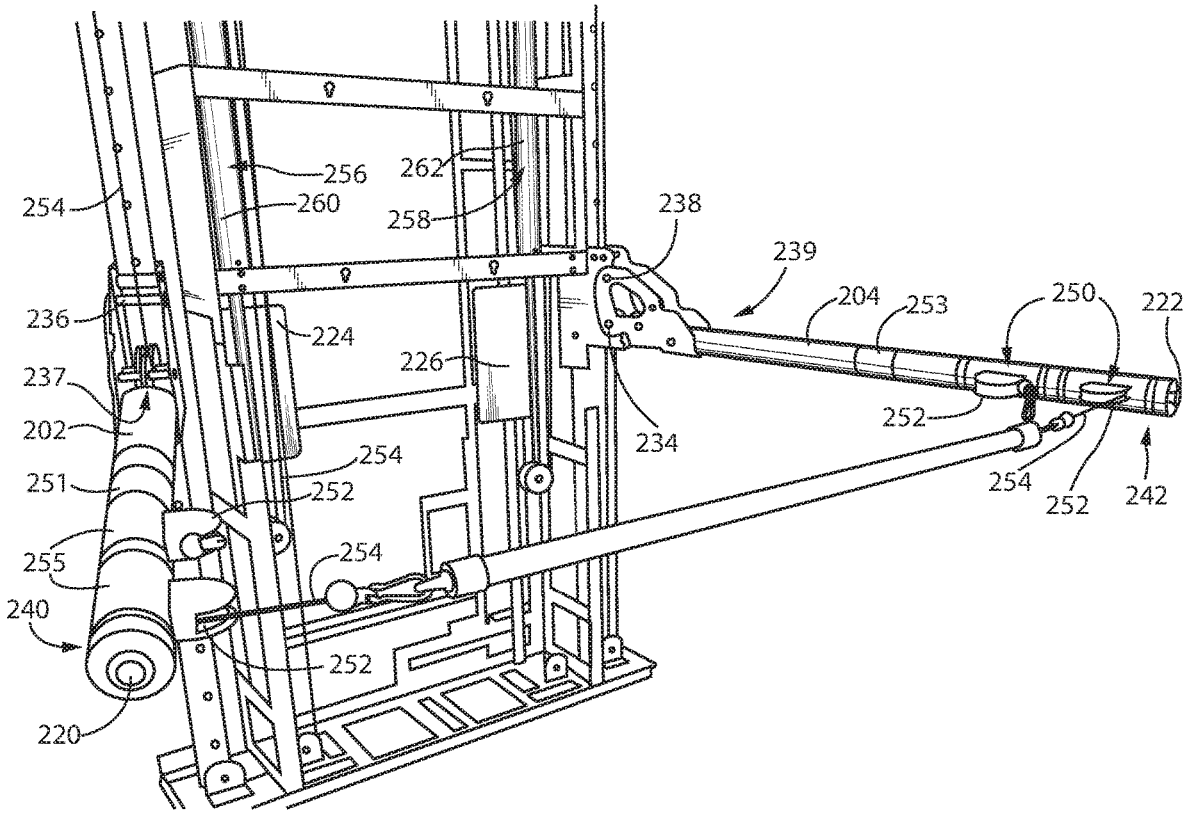
Figure 3E:
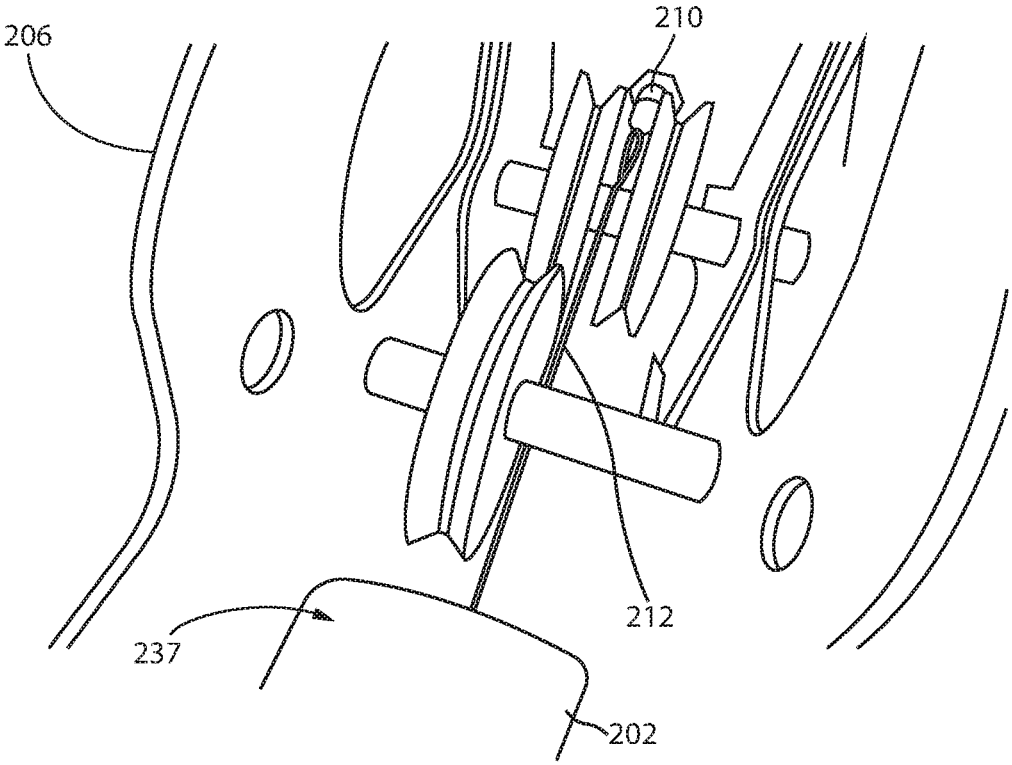

In some embodiments, the handles 244 may be a bar 244 as shown in FIG. 3D. As described for the handles 244, 246 discussed previously, the bar 244 may be equipped with gas input and release actuators to allow resistance adjustment without removing the user's hands from the bar 244.

In some embodiments, a monitor 302 may be provided to visually display a variety of information pertaining to the exercise, such as workings of the exercise device 100, the exercise routine, the performance of the user, and the like. The monitor 302 may be operatively connected to the controller. In some embodiments, the controller may be housed in the monitor 302.

The monitor 302 may be an interactive touch screen with the controller integrated into the monitor and that allows the user to display certain information, such as performance data, and control various aspects of the exercise device 100 and/or control an exercise program. For example, the controller may be operatively connected to the measuring device to process power information. The measuring device can measure pressure information in the gas tubes 260, 262 and/or speed and position information of the piston. The controller can process these measured data to determine such performance data as the number of repetitions, the number of sets, the time, the duration of an exercise, the amount of energy burned, the amount of power exerted on pulling the handles, and the like. So, the controller processes power information and converts the power information into performance data for display on the monitor. The performance data may be displayed in a format that is informative to the user. In some embodiments, additional sensors may be operatively connected to the controller and monitor 302 to detect and display information regarding the user, such as calories burned, heart rate, and the like. A camera or other sensor may also be utilized to monitor the user and to instruct the user on positioning, technique, or the like, either through the controller or a human trainer monitoring the user remotely, or it could be used to record the user and track progress over multiple sessions. In alternative embodiments, the monitor 302 may be connected with other content or electronic devices to act as a television, computer, videophone, or other electronic device that uses a monitor, to increase the versatility of the device. In other alternative embodiments, the exercise device 100 may incorporate a voice activated assistant, such as Amazon Echo, Google Home, Apple HomePod, etc., which may be used with the monitor 302. In such embodiments, the exercise device 100 may be more than just an exercise device.

In some embodiments, controller comprises a processor, a database for storing information, and a memory operatively coupled to the processor, the memory storing program instructions that when executed by the processor causes the processor to execute an exercise programs for display on the monitor, designed to motivate or distract the exerciser from the potential monotony or intensity of an exercise routine. For example, the monitor and controller may display a game in which the exerciser performs various movements to advance through the game, which also happen to be the exercise movements. In some embodiments, the exercise program may display a second party. For example, the exercise program may display a trainer providing instructions to the user. The instructions may be to tell the user what to do next or simply words of encouragement. In some embodiments, the instructions may be based on the power information of the user. So, if the controller detects the user is slowing down, the trainer may instruct the user to speed up or make some other statement to motivate the user to speed up or continue pressing forward. In some embodiments, voice activation may be used to communicate with the controller.

In some embodiments, the second party may be a second user. The exercise program may display a second power information on the monitor for the first user to see, wherein the second power information is based on an exercise performed by the second user. Based on the second user's power information, the first user may be motivated to work harder.

In some embodiments, the monitor may play a preprogrammed exercise routine with a trainer guiding the user through an exercise routine. In some embodiments, the exercise device 100 may comprise a camera operatively connected to the monitor so that user can see himself or herself. In some embodiments, the camera may be attached to provide a two-way video link. This allows a user to interact live, in real time, with another user at a remote location. The second user may be a personal trainer providing instruction and motivation. The second user may also be a friend or groups of friends working out together or competing against each other.

The monitor 302 may be attached to the frame 102. In the preferred embodiment, the monitor 302 is attached to the frame 102 in between the arms 202, 204. In some embodiments, the exercise device 100 may further comprise a sound system operatively connected to the monitor. The sound system can allow multiple inputs like wireless or wired music streaming services, or downloaded music.

Figure 6:
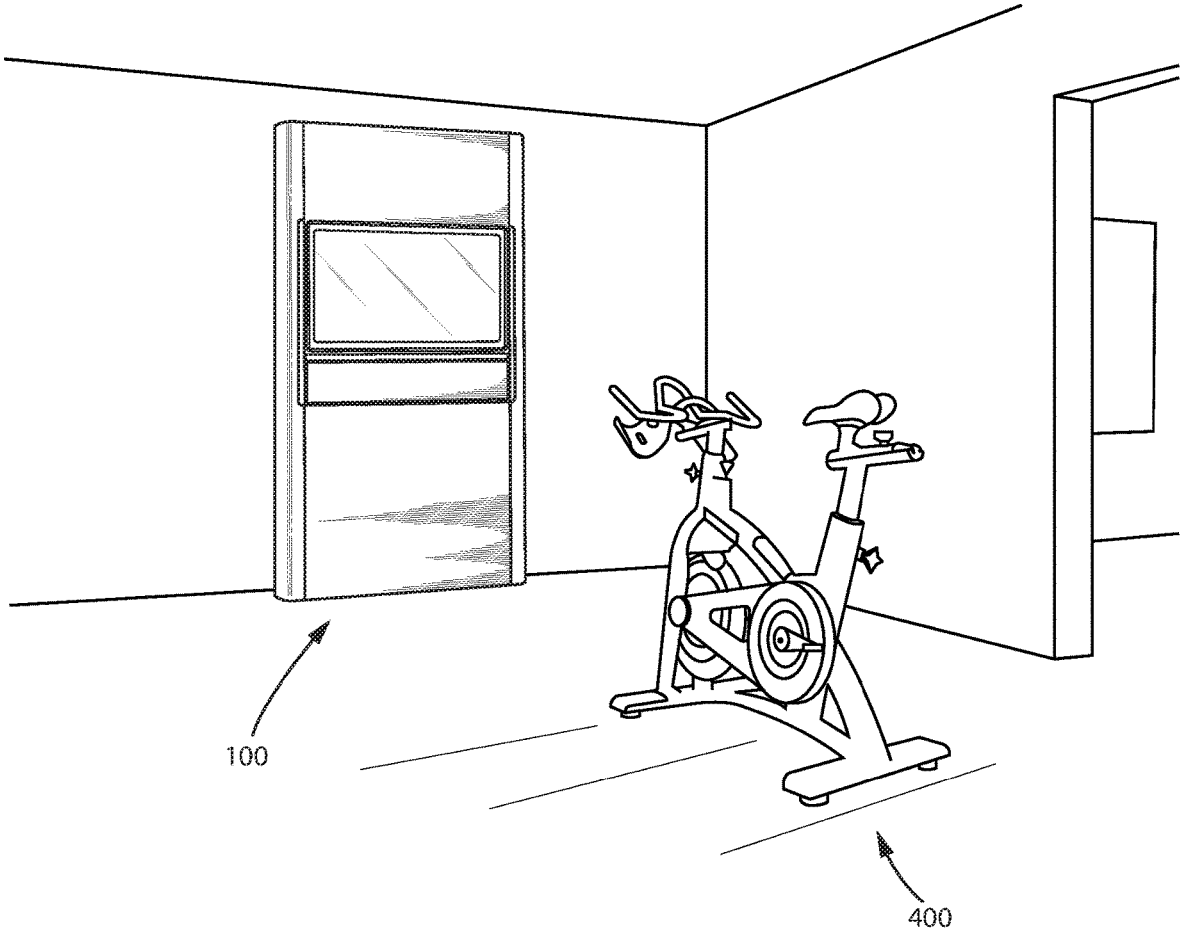
FIG. 6 shows another embodiment of the present invention with an accessory device.

Other accessories 400 can be connected wirelessly, such as stationary bikes, treadmills, ellipticals, row machines, stair climbers, and the like, as shown in FIG. 6. The data connection can appear on the monitor and interact with the user and the accessory device 400.

When not in use, with the arms 202, 204 stowed, the aesthetic appeal of the panels 104, 106, 108, which substantially cover the entire exercise device 100 except the monitor 402, is sufficient to allow the exercise device 100 to be placed in almost any room without looking like an out of place exercise device. The design of the exercise device 100 also creates a pocket in between the gas tubes. This pocket can be utilized to store a bench 300 as shown in FIG. 5, or other articles such as spare handles or other accessories.

In use, the user opens the side panels 106, 108 exposing the arms 202, 204. The user actuates the arm releases 251, 253 to disengage the rotation locks 236, 238 and deploy the arms 202, 204. The user actuates the carriage releases 220, 222 to adjust the height of the arms 202, 204. The user can confirm the desired handles 244, 246 or replace the handles 244, 246 with the desired handles based on the type of exercise the user wants to perform. The controller and monitor 302 may be turned on and the user can select the program to execute. The program may be a game, an exercise routine, a training program, a competition, a movie, a television program, and the like. In some embodiments, the controller may be connected to the Internet, thereby allowing the user to interact with other users connected with each other on the Internet. Therefore, multiple users may exercise together or compete with each other through one of the exercise programs. When the exercise is complete, the user can stow the arms 202, 204 back into their stowed configuration and close the side panels 106, 108. In the closed configuration, the monitor 302 may remain exposed. As such, the monitor 302 may be used like a standard television. In some embodiments, the monitor may also be hidden when not in use.

The configuration described herein allows the user to perform many different types of exercises with one compact machine, such as curls, presses, lat pulls, dips, squats, leg lifts, leg pulls, hip flexes, trunk twists, ab crunches, butterflies, and the like.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. An exercise system, comprising:

(a) a frame, comprising a first slide pole;

(b) a resistance generator operatively connected to the frame;

(c) a pulley system;

(d) a first arm operatively attached to the frame and the pulley system;

(e) a first carriage operatively connected to the first arm and movably mounted on the first slide pole, wherein the first carriage is configured for translational movement along the first slide pole to move the first arm up and down for height adjustment of the first arm, wherein the first carriage is configured for rotational movement with the first slide pole to adjust a lateral position of the first arm, and wherein the first arm is connected to the first carriage by a first hinge to allow the first arm to pivot relative to the first carriage between a stowed configuration of the first arm and a deployed configuration of the first arm, wherein the pulley system comprises a cable having a first end and a second end, wherein the cable is routed through the first arm and operatively connected to the resistance generator, wherein the first end of the cable projects out of the first arm at a first distal position on the first arm, wherein the second end of the cable projects out from the first arm at a second distal position closer to the frame than the first distal position when the first arm is in the deployed configuration, (f) a handle interchangeably connectable to the first end and the second end of the cable, the handle comprising a gas actuator to control the resistance generator;

(g) a first side panel movably attached to the frame, wherein the first side panel can be moved into an open configuration of the first side panel and a closed configuration of the first side panel, wherein the first arm is positioned adjacent to the first side panel, such that when the first arm is in the stowed configuration and the first side panel is in the closed configuration, the first arm is hidden from sight;

(h) a second slide pole mounted to the frame;

(i) a second arm operatively attached to the frame and the pulley system;

(j) a second carriage operatively connected to the second arm and movably mounted on the second slide pole, wherein the second carriage is configured for translational movement along the second slide pole to move the second arm up and down for height adjustment of the second arm, wherein the second carriage is configured for rotational movement with the second slide pole to adjust a lateral position of the second arm, and wherein the second arm is connected to the second carriage by a second hinge to allow the second arm to pivot relative to the second carriage between a stowed configuration of the second arm and a deployed configuration of the second arm;

(k) a monitor positioned in between the first side panel and a second side panel, wherein the second side panel is adjacent to the second arm and movable between a closed configuration of the second side panel and an open configuration of the second side panel to hide and expose the second arm, wherein the monitor extends substantially from the first side panel to the second side panel, wherein when the first arm and the second arm are in their respective stowed configurations, and the first side panel and the second side panel are in their respective closed configurations, the monitor is exposed.

2. The exercise system of claim 1, wherein the resistance generator is a pneumatic cylinder.

3. The exercise system of claim 2, wherein the resistance generator further comprises a gas hose to feed compressed air into the pneumatic cylinder, and a gas compressor operatively connected to the gas hose to generate compressed gas for delivery into the pneumatic cylinder.

4. The exercise system of claim 3, wherein the resistance generator further comprises an equalizer tank to control pressure in the pneumatic cylinder during use.

* * * * *